US005209279A

United States Patent [19]

Wilson

[11] Patent Number: 5,209,279

[45] Date of Patent: May 11, 1993

[54] DUAL UNIT HANDBAG

[76] Inventor: Johnny D. Wilson, 40 S. Van Dorn St. #D40, Alexandria, Va. 22304

[21] Appl. No.: 800,131

[22] Filed: Nov. 29, 1991

[51] Int. Cl.[5] ..... A45C 1/02; A45C 3/06; A45C 5/06

[52] U.S. Cl. ..... 150/111; 150/113; 190/108; 190/110; 383/37

[58] Field of Search ..... 224/151, 153, 209, 210; 190/103, 108, 110; 383/37; 150/111, 113

[56] References Cited

U.S. PATENT DOCUMENTS

| | | | |
|---|---|---|---|
| 662,263 | 4/1899 | Pritchard et al. | 190/110 |
| 1,341,099 | 5/1920 | Abramson | 190/103 |
| 2,223,029 | 11/1940 | Dunton | 224/151 X |
| 2,428,906 | 10/1947 | Cannella | 150/111 |
| 2,672,903 | 3/1954 | Machinist | 150/111 |
| 2,801,666 | 8/1957 | Steele | 150/113 |
| 2,813,602 | 11/1957 | MacArthur, Jr. . | |
| 3,061,057 | 10/1962 | Miller | 190/110 |
| 3,696,850 | 10/1972 | Rosenblum | 190/108 |
| 3,726,329 | 4/1973 | Dean . | |
| 3,963,102 | 6/1976 | Carp . | |
| 4,081,061 | 3/1978 | Tucker | 190/108 |
| 4,415,012 | 11/1983 | Böse | 383/37 |
| 4,424,841 | 1/1984 | Smith | 190/108 X |
| 4,756,394 | 7/1988 | Cohen | 190/108 X |

FOREIGN PATENT DOCUMENTS

| | | | |
|---|---|---|---|
| 189539 | 8/1986 | European Pat. Off. | 224/153 |
| 1562995 | 4/1969 | France | 190/108 |
| 2573635 | 5/1986 | France | 190/103 |
| 22100 | of 1906 | United Kingdom | 190/110 |
| 840343 | 7/1960 | United Kingdom | 190/110 |
| 2018580 | 10/1979 | United Kingdom | 190/103 |

*Primary Examiner*—Sue A. Weaver
*Attorney, Agent, or Firm*—Richard C. Litman

[57] ABSTRACT

A woman's handbag is provided with an upper compartment and a removable lower compartment. The lower compartment is discreet and separable from the upper compartment. The upper compartment is connected to the lower compartment by a zipper, for example, which is hidden by a flap. The upper compartment may be securable by a latch (hasp) and can include an arm strap for carrying. The lower compartment is securable by flexible walls which close from the top and is secured by a latch. The lower compartment has a removable arm strap for carrying.

16 Claims, 1 Drawing Sheet

FIG. 1
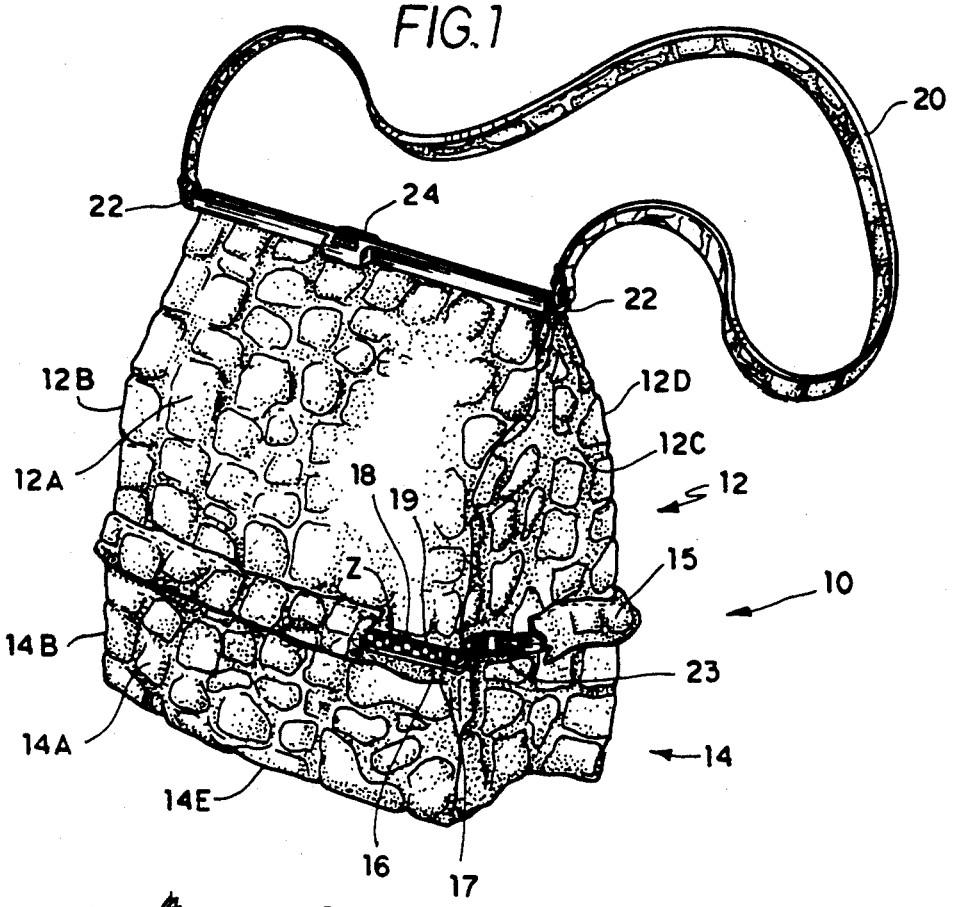
FIG. 2
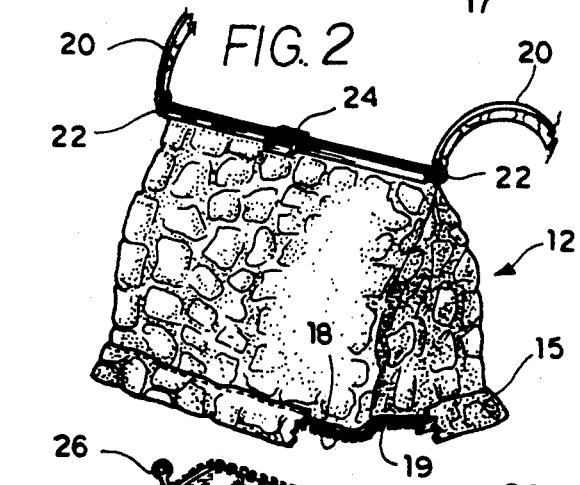
FIG. 3
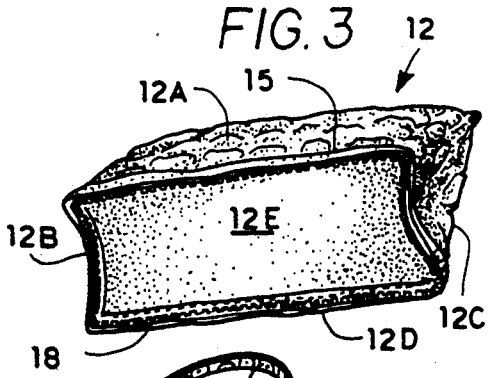
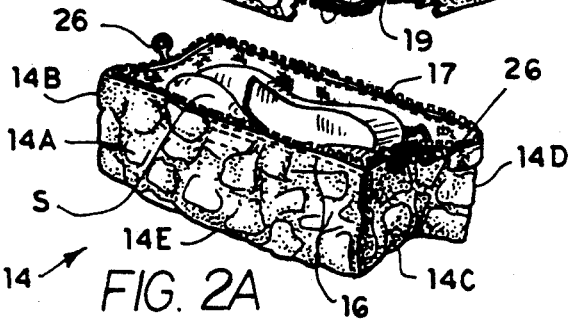
FIG. 2A
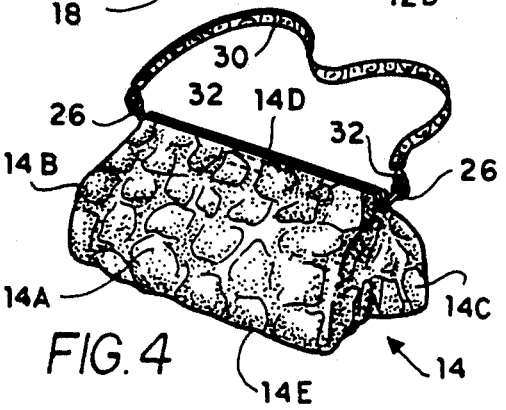
FIG. 4

DUAL UNIT HANDBAG

FIELD OF THE INVENTION

The present invention relates to a woman's handbag of unitary construction having an upper compartment and a separable lower compartment. The lower compartment is intended to store accessories not ordinarily found in a woman's handbag.

DESCRIPTION OF THE PRIOR ART

Luggage with detachable components are known in the art. U.S. Pat. No. 2,813,602 issued on Nov. 19, 1957 to John J. MacArthur, Jr. discloses twin bags. These are somewhat similar to saddle bags and are adapted to be slung over a suitcase so that they can be carried as a unit with the suitcase. A lower compartment is provided which is accessible by a zipper. The lower compartment is permanently secured to the upper compartment.

U.S. Pat. No. 3,726,329 issued on Apr. 10, 1973 to Jesse Dean discloses a multi-unit bag made of separable units. Each unit is capable of functioning as a single bag, or to be connected together to form a single large bag.

U.S. Pat. No. 3,963,102 issued on Jun. 15, 1976 to Bess Carp discloses a combination carry-on luggage bag with a tote bag and a clutch bag. The tote bag and clutch bag are stored interiorly of the main unit and are removable.

U.S. Pat. No. 4,756,394 issued on Jul. 12, 1988 to Fred Cohen discloses expandable hand luggage with wheels and separable compartments. A generally rectangular case with wheels is provided with means to expand to a second compartment in the form of a collapsible bag when additional storage is required.

None of the above referenced devices, considered either singly or in combination, is seen to suggest the instant invention as claimed.

SUMMARY OF THE INVENTION

The instant invention is concerned with a woman's handbag with a top compartment and a removable lower compartment. The lower compartment is for holding accessories such as shoes which are not ordinarily found in a handbag. The top compartment is removably connected to the bottom compartment by suitable connection means such as a zipper. The top compartment may have a strap which can be permanently attached and the lower compartment can include a non-permanently attached strap. Both the top compartment and the lower compartment can act as individual handbags, or the combination of two when connected together can act as a single handbag.

Accordingly, one object of the present invention is to provide a woman's handbag with a separable compartment for carrying accessories not normally carried in a handbag.

Another object of the present invention is to provide a dual unit handbag where it is not obvious that the handbags are separable.

These and other objects of the present invention will become readily apparent upon further review of the following specification and drawings.

BRIEF DESCRIPTION OF THE DRAWINGS

FIG. 1 is a cut away perspective view of the dual unit handbag;

FIG. 2 is a perspective view of the upper compartment of the dual unit handbag;

FIG. 2A is a perspective view of the lower compartment of the dual unit handbag in the open position;

FIG. 3 is a perspective view of the upper compartment of the dual unit handbag showing the bottom panel; and FIG. 4 is a perspective view of the lower compartment of the dual unit handbag in the closed position with the removable strap attached.

Similar reference characters denote corresponding features consistently throughout the attached drawings.

DETAILED DESCRIPTION OF THE PREFERRED EMBODIMENT

The present invention is a woman's handbag 10 with an upper compartment 12 and a removable lower compartment 14. The upper compartment 12 has a front panel 12A, a left side panel 12B, a right side panel 12C, a back panel 12D, and a bottom panel 12E. The upper compartment 12 acts as a self contained unit with the front panel 12A connected to the right side panel 12C and the left side panel 12B. The back panel 12D is also connected to the right side panel 12C and the left side panel 12B. All of the upper compartment panels (12A, 12B, 12C, and 12D) are connected to the bottom panel 12E.

The lower compartment 14 has a lower front panel 14A, a lower left side panel 14B, a lower right side panel 14C a lower back panel 14D and a lower bottom panel 14E. The lower compartment 14 acts as a self contained unit with the lower front panel 14A connected to the lower right side panel 14C and the lower left side panel 14B. The lower back panel 14D is also connected to the lower right side panel 14C and the lower left side panel 14B. All of the lower compartment panels (14A, 14B, 14C, and 14D) are connected to the lower bottom panel 14E.

The lower compartment 14 is another self contained unit, the lower compartment 14 attaches to the top compartment 12 by a zipper Z. The zipper Z has teeth 18 attached to the top compartment 12 by stitching 19. The zipper Z has mating teeth 17 attached to the lower compartment 14 by stitching 16. A zipper slide 23 connects teeth 18 of the upper compartment 12 with mating teeth 17 of the lower compartment 14. The zipper Z connects the upper compartment 12 to the lower compartment 14 giving a single integral handbag 10. The zipper Z, zipper slide 23, teeth 18, and mating teeth 17 are all hidden by flap 15. The flap 15 is attached on the lower portion of the four upper panels (12A, 12B, 12C, and 12D) and completely extends over the zipper Z.

The upper compartment 12 closes at the top by a latch 24. An arm strap 20 is attached to the upper compartment 12 by two connectors 22. The arm strap 20 is permanently connected to the upper compartment 12. The upper compartment 12 is designed to carry ordinary woman's handbag items such as make-up, wallet and credit cards, etc.

The lower compartment 14 is closed by a latch and is shown in the closed configuration in FIG. 4. The snap shut feature is accomplished by pushing the lower front panel 14A together with the lower back panel 14D of the lower compartment 14. This closes the lower compartment 14. A removable arm strap 30 is provided. The removable arm strap 30 is connected to lower compartment connectors 26 by two snap rings 32 located one on each end of the lower compartment strap 30. The lower compartment 14 is designed to carry accessories not commonly carried in a woman's handbag, such as shoes S, sneakers, etc. Shoes S are shown in FIG. 2A, placed inside the lower compartment 14.

When the lower compartment 14 is removed from upper compartment 12, upper compartment 12 can be carried separately. When compartment 12 is carried by itself, flap 15 completely extends over teeth 18 of zipper Z, hiding teeth 18 from view. Likewise, lower compartment 14 can be carried independently of upper compartment 12 when lower compartment 14 is shut as shown in FIG. 4. Hence, a user could carry each compartment separate from the other, without the appearance that both compartments are connectable to each other.

It is to be understood that the present invention is not limited to the sole embodiment described above, but encompasses any and all embodiments within the scope of the following claims.

I claim:

1. A woman's handbag comprising:

an upper compartment having a front panel, a left side panel, a right side panel, a back panel, and a bottom panel, said upper compartment acting as a self contained unit with said left side panel and said right side panel both connected to the front panel and the back panel, said front, left side, right side and back panels of said upper compartment panels being connected to the bottom panel;

a lower compartment having a lower front panel, a lower left side panel, a lower right side panel, a lower back panel and a lower bottom panel, said lower compartment acting as a self contained unit with said lower right side panel and lower left side panel being connected to said lower front panel and lower back panel, said lower front, lower left side, lower right side and lower back panels of said lower compartment panels being connected to the lower bottom panel;

said lower compartment being connected to said upper compartment by a zipper hidden by a flap, said zipper being located adjacent said bottom panel of said upper compartment and a top portion of said lower compartment, said flap being attached on a lower portion of the front panel, the left side panel, the right side panel and the back panel of the upper compartment, and extending downward over the zipper;

said lower compartment being removable from said upper compartment and having a opening therein carrying accessories such as shoes and related items, and having means to close said lower compartment, whereby said upper and lower compartments form two self contained handbags.

2. A woman's handbag as defined in claim 1, wherein said means to close said lower compartment includes a latch, whereby closure is accomplished by pushing the lower front panel of said lower compartment together with the lower back panel of said lower compartment.

3. A woman's handbag as defined in claim 1, including an armstrap attached to said upper compartment by a plurality of connectors.

4. A woman's handbag as defined in claim 1, including an armstrap attachable to said lower compartment by a plurality of connectors.

5. A woman's handbag as defined in claim 4, wherein said lower compartment strap is removably connected to said lower compartment at two posts.

6. A woman's handbag as defined in claim 5, wherein said posts are located at top portions of said lower right side panel and said left side panel of the lower compartment.

7. A woman's handbag as defined in claim 1, wherein said zipper comprises a first and second row of teeth with a slide, said first row of teeth connected by stitching to said upper compartment, said second row of teeth connected to said lower compartment by stitching at the top portion thereof, said slide being disposed on said first row of teeth, wherein said slide connects the first row of teeth to said second row of teeth thereby connecting said upper compartment to said lower compartment.

8. A woman's handbag as defined in claim 7, wherein said flap covers the first row of teeth of said zipper when said lower compartment is removed from said upper compartment, thereby providing concealment of the first row of teeth of the zipper when the upper compartment is being used without the lower compartment.

9. A woman's handbag comprising:

an upper compartment having a front panel, a left side panel, a right side panel, a back panel, and a bottom panel, said upper compartment acting as a self contained unit with said left side panel and said right side panel both connected to the front panel and the back panel said front, left side, right side and back panels of said upper compartment panels being connected to the bottom panel;

a lower compartment having a lower front panel, a lower left side panel, a lower right side panel, a lower back panel and a lower bottom panel, said lower compartment acting as a self contained unit with said lower right side panel and lower left side panel being connected to said lower front panel and lower back panel, said lower front, lower left side, lower right side and lower back panels of said lower compartment panels being connected to the lower bottom panel;

said lower compartment being connected to said upper compartment by a closure means hidden by a flap, said closure means being located adjacent said bottom panel of said upper compartment and a top portion of said lower compartment, said flap being attached on a lower portion of the front panel, the left side panel, the right side panel and the back panel of the upper compartment, and extending downward over the closure means;

said lower compartment being removable from said upper compartment and having an opening therein for carrying accessories such as shoes and related items, and having means to close said lower compartment, whereby said upper and lower compartments form two self contained handbags.

10. A women's handbag as defined in claim 9, wherein said means to close said lower compartment includes a latch, whereby closure is accomplished by pushing the lower front panel of said lower compartment together with the lower back panel of said lower compartment.

11. A woman's handbag as defined in claim 9, including an armstrap attached to said upper compartment by a plurality of connectors.

12. A woman's handbag as defined in claim 9, including an armstrap attachable to said lower compartment by a plurality of connectors.

13. A woman's handbag as defined in claim 12, wherein said lower compartment strap is removably connected to said lower compartment at two posts.

14. A woman's handbag as defined in claim 13, wherein said posts are located at top portions of said lower right side panel and said left side panel of the lower compartment.

15. A woman's handbag as defined in claim 9, wherein said closure means comprises first and second closure elements, said first closure element connected to said upper compartment, said second closure element connected to said lower compartment at the top portion thereof, wherein said first closure element is detachably connected to said second closure element thereby connecting said upper compartment to said lower compartment.

16. A woman's handbag as defined in claim 15, wherein said flap covers the first closure element of said closure means when said lower compartment is removed from said upper compartment, thereby providing concealment of the first closure element of the closure means when the upper compartment is being used without the lower compartment.

* * * * *